US011070923B2

(12) United States Patent
Petrausch et al.

(10) Patent No.: US 11,070,923 B2
(45) Date of Patent: Jul. 20, 2021

(54) METHOD FOR DIRECTIONAL SIGNAL PROCESSING FOR A HEARING AID AND HEARING SYSTEM

(71) Applicant: SIVANTOS PTE. LTD., Singapore (SG)

(72) Inventors: Stefan Petrausch, Erlangen (DE); Tobias Daniel Rosenkranz, Bubenreuth (DE)

(73) Assignee: Svantos Pte. Ltd., Singapore (SG)

( * ) Notice: Subject to any disclaimer, the term of this patent is extended or adjusted under 35 U.S.C. 154(b) by 0 days.

(21) Appl. No.: 16/841,869

(22) Filed: Apr. 7, 2020

(65) Prior Publication Data

US 2020/0336844 A1 Oct. 22, 2020

(30) Foreign Application Priority Data

Apr. 18, 2019 (DE) ..... 10 2019 205 709

(51) Int. Cl.
*H04R 25/00* (2006.01)

(52) U.S. Cl.
CPC ..... *H04R 25/407* (2013.01)

(58) Field of Classification Search
USPC ..... 381/312–313
See application file for complete search history.

(56) References Cited

U.S. PATENT DOCUMENTS 6,865,275 B1 3/2005 Roeck
7,630,507 B2 12/2009 Kates
10,231,064 B2 3/2019 Rosenkranz et al.
2003/0215106 A1* 11/2003 Hagen ..... H04R 25/552 381/313
2010/0260364 A1* 10/2010 Merks ..... H04R 25/407 381/313
2011/0228961 A1* 9/2011 Arndt ..... H04R 25/407 381/313

(Continued)

FOREIGN PATENT DOCUMENTS

DE 10 2015 210 652 A1 12/2016
DE 10 2016 225 207 A1 6/2018

(Continued)

*Primary Examiner* — Suhan Ni

(74) *Attorney, Agent, or Firm* — Laurence A. Greenberg; Werner H. Stemer; Ralph E. Locher

(57) ABSTRACT

A method performs directional signal processing for a hearing aid. First and second input transducers of the hearing aid generate first and second input signals, respectively, from a sound signal. A first calibration directional signal which has a relative attenuation in the direction of a first useful signal source is generated from the first and second input signals, and a second calibration directional signal which has a relative attenuation in the direction of a second useful signal source is generated from the first and second input signals. A relative gain parameter is determined from the first and second calibration directional signals. First and second processing directional signals are generated from both the first and second input signals. A source-sensitive directional signal is generated from the first and second processing directional signals and the relative gain parameter. An output signal of the hearing aid is generated from the source-sensitive directional signal.

13 Claims, 4 Drawing Sheets

(56) References Cited

U.S. PATENT DOCUMENTS

| | | | | |
|---|---|---|---|---|
| 2015/0222996 | A1* | 8/2015 | Chu | H04R 25/43<br>381/313 |
| 2018/0176697 | A1 | 6/2018 | Kamkar-Parsi et al. | |

FOREIGN PATENT DOCUMENTS

| | | | |
|---|---|---|---|
| EP | 3104627 | A1 | 12/2016 |
| EP | 3337188 | A1 | 6/2018 |

* cited by examiner

METHOD FOR DIRECTIONAL SIGNAL PROCESSING FOR A HEARING AID AND HEARING SYSTEM

CROSS-REFERENCE TO RELATED APPLICATION

This application claims the priority, under 35 U.S.C. § 119, of German application DE 10 2019 205 709.8, filed Apr. 18, 2019; the prior application is herewith incorporated by reference in its entirety.

BACKGROUND OF THE INVENTION

Field of the Invention

The invention relates to a method for directional signal processing for a hearing aid. A first input transducer of the hearing aid generates a first input signal from a sound signal in the environment. A second input transducer of the hearing aid generates a second input signal from the sound signal in the environment. A first directional signal which has a relative attenuation in the direction of a first useful signal source in the environment is generated on the basis of the first input signal and on the basis of the second input signal. A second directional signal which has a relative attenuation in the direction of a second useful signal source in the environment is generated on the basis of the first input signal and on the basis of the second input signal. A source-sensitive directional signal is generated on the basis of the first directional signal, the second directional signal and the relative gain parameter.

In a hearing aid, ambient sound is converted, by means of at least one input transducer, into an input signal which, depending on a hearing deficiency of the wearer to be corrected, is processed in a manner specific to the frequency band and in this case, in particular, in a manner individually matched to the wearer and is also amplified in the process. The processed signal is converted, via an output transducer of the hearing aid, into an output sound signal which is passed to the wearer's hearing. In the course of signal processing, automatic gain control (AGC) and dynamic compression are often applied to the input signal or to an intermediate signal which has already been preprocessed, during which the input signal is usually linearly amplified only to a particular limit value and a lower amplification is applied above the limit value in order to thereby compensate for peak levels of the input signal. This is intended to prevent, in particular, sudden loud sound events caused by the additional amplification in the hearing aid from resulting in an output sound signal which is excessively loud for the wearer.

However, such AG with integrated dynamic compression initially reacts in this case to sound events independently of their direction. If the wearer of a hearing aid is in a complex hearing situation, for example in a conversation with a plurality of interlocutors, an interlocutor can trigger the compression, for example as a result of a short scream or loud laughing, as a result of which the conversation contributions by another interlocutor are significantly reduced, thus affecting the comprehensibility for the wearer.

SUMMARY OF THE INVENTION

The invention is based on the object of specifying a method for signal processing in a hearing aid, which method is also suitable, in particular in conjunction with AGC and dynamic compression, for complex hearing situations.

According to the invention, the object is achieved by means of a method for directional signal processing for a hearing aid. A first input transducer of the hearing aid generates a first input signal from a sound signal in the environment, and a second input transducer of the hearing aid generates a second input signal from the sound signal in the environment. A first calibration directional signal which has a relative attenuation in the direction of a first useful signal source in the environment is generated on the basis of the first input signal and on the basis of the second input signal, and a second calibration directional signal which has a relative attenuation in the direction of a second useful signal source in the environment is generated on the basis of the first input signal and on the basis of the second input signal. A relative gain parameter is determined on the basis of the first calibration directional signal and the second calibration directional signal. A first processing directional signal and a second processing directional signal are each generated on the basis of both the first input signal and the second input signal. A source-sensitive directional signal is generated on the basis of the first processing directional signal, the second processing directional signal and the relative gain parameter, and an output signal of the hearing aid is generated on the basis of the source-sensitive directional signal and is preferably converted into an output sound signal by an output transducer of the hearing aid. The subclaims and the following description relate to configurations which are advantageous and in some cases inventive per se.

In this case, an input transducer includes, in particular, an electroacoustic transducer which is configured to generate a corresponding electrical signal from a sound signal. In particular, preprocessing, for example in the form of linear pre-amplification and/or A/D conversion, can also be carried out when generating the first and/or second input signal by means of the respective input transducer.

The generation on the basis of the first and/or second calibration directional signal on the basis of the first and second input signals preferably contains directly including the signal components of the first and second input signals in the respective calibration directional signal and therefore, in particular, not using the first and second input signals both at the same time only to generate control parameters or the like which are applied to signal components of other signals. In this case, preferably at least the signal components of the first input signal, and particularly preferably also the signal components of the second input signal, are linearly included in the first calibration directional signal. A comparable situation preferably also applies to the second calibration directional signal.

In this case, the first and second calibration directional signals may be formed, in particular, on the basis of intermediate signals which are each generated on the basis of the first and second input signals. For example, a directed first intermediate signal and also a directed second intermediate signal can be formed on the basis of the first and second input signals, wherein the directional characteristics of the first and second intermediate signals preferably have symmetry with respect to one another, for example as a cardioid and an anti-cardioid. The first calibration directional signal can then be generated from the first and second intermediate signals on the basis of adaptive directional microphony in such a manner that a relative attenuation in the direction of the first useful signal source occurs as a result of the adaptive directional microphony, as required. A comparable situation applies to the second calibration directional signal.

A relative attenuation of the first and/or second calibration directional signal should be understood here as meaning, in particular, the fact that the relevant directional characteristic has, in the direction of the respective useful signal, a sensitivity which is reduced in comparison with the sensitivity averaged over all directions and, in particular, has a local, preferably a global, minimum.

The relative gain parameter should preferably be generated on the basis of the first and second calibration directional signals in such a manner that, if the signal components of the first and second calibration directional signals are accordingly superposed and weighted with the relative gain parameter, an output signal resulting from such superposition can be controlled as far as possible using common AGC and, in particular, using common dynamic compression, and the signal components impinging from at least two directions are considered and weighted as optimally as possible for this purpose.

The relative gain parameter can then be used, in particular, for a superposition of the first processing directional signal with the second processing directional signal. In this case, the first and second processing directional signals are preferably generated on the basis of the same intermediate signals as the first and second calibration directional signals. However, a further, preferably common, degree of freedom, for example in the form of an additional adjustment parameter or the like, can be added, in particular, both to the first intermediate signal and to the second intermediate signal when generating the processing directional signals, which degree of freedom is not present in the calibration directional signals. Such an additional degree of freedom allows the sensitivity of the directional characteristic of the source-sensitive directional signal to be adjusted, by varying the adjustment parameter, in particular on the basis of the relative gain parameter, in the direction both of the first useful signal source and of the second useful signal source, which makes it possible to subsequently deal with the source-sensitive directional signal or the output signal generated therefrom by means of AGC and corresponding dynamic compression in a manner which takes into account the two useful signals from said useful signal sources. However, as an alternative to the adjustment parameter, the degree of freedom required for this purpose can also be introduced into a superposition of the two processing directional signals, for example in the form of a complex-value superposition parameter when generating the source-sensitive directional signal.

In order to now be able to thus use AGC and possibly corresponding dynamic compression in a hearing aid in complex hearing situations, in particular conversations with a plurality of interlocutors, without attenuating individual signals (for example conversation contributions) as a result of the peak levels of another sound signal, the first and second calibration directional signals are preferably determined in the present case in such a manner that the sound events of one useful signal source (for example speech contributions by one interlocutor in each case) are emphasized as far as possible and the sound events of a further useful signal source (for example speech contributions by a further interlocutor) are suppressed as far as possible, in which case the roles of the sound events to be suppressed and emphasized in each case are interchanged for the two calibration directional signals.

The relative gain parameter is now preferably determined on the basis of these two calibration directional signals in such a manner that a corresponding superposition of the two calibration directional signals—that is to say, for example, a superposition of the first calibration directional signal with the second calibration directional signal which is weighted with the relative gain parameter—can be controlled by means of a common AGC value on account of the described suppression and emphasis of the respective sound events. Excessive influences of a sound event in the superposed signal can be avoided by means of the respective other sound event.

The source-sensitive directional signal, from which the output signal is possibly generated by means of additional signal processing, is now not generated from a superposition of the two calibration directional signals, but rather on the basis of the two processing directional signals. This is carried out because a superposition of the two calibration directional signals for further processing could result in the direction of maximum attenuation of the superposed signal fluctuating in a wider angular range of up to 90° depending on the sound events of the useful signal sources, as can occur during adaptive directional microphony, for example. In particular, this direction no longer coincides with the direction of one of the useful signal sources.

As described above, an additional degree of freedom can now be introduced using the two processing directional signals depending on the relative gain parameter determined on the basis of the calibration directional signals, as a result of which the direction of the maximum attenuation can be stabilized in the source-sensitive directional signal. A sudden change in the sound from a useful signal source now results, by accordingly changing the relative gain parameter and another weighting of the two processing directional signals which results therefrom, in the signal contributions of the other useful signal source not being affected or being affected only to a minimum extent by this change in the source-sensitive directional signal in the case of AGC with dynamic compression.

A third input transducer of the hearing aid can preferably generate a third input signal, with the result that a total of three calibration directional signals are generated on the basis of the available input signals and each have a relative attenuation in the direction of another of three useful signal sources. Two relative gain parameters can then be determined on the basis of the three calibration directional signals, with the result that three processing directional signals which are in turn generated on the basis of the three input signals are superposed on the basis of the two relative gain parameters. The method can extend to even higher-order systems in the input transducers.

Expediently, a first instantaneous gain parameter is determined on the basis of the first calibration directional signal and a second instantaneous gain parameter is determined on the basis of the second calibration directional signal, wherein the relative gain parameter is determined on the basis of the first instantaneous gain parameter and the second instantaneous gain parameter, in particular as a quotient thereof. In this case, the first instantaneous gain parameter and the second instantaneous gain parameter are preferably determined as "isolated" values of AGC or dynamic compression for the respective calibration directional signal. As a result, each of the two useful signal sources is therefore "calibrated" "per se", by means of the corresponding calibration directional signal which attenuates the respective other useful signal, using corresponding AGC, and the relative gain parameter is determined on the basis of these isolated AGC values.

A first intermediate signal and a second intermediate signal are each expediently generated on the basis of both the first input signal and the second input signal. This makes it possible to generate the calibration directional signals and/or the processing directional signals on the basis of adaptive directional microphony, wherein the intermediate signals are used in the adaptive directional microphony.

Preferably, the first calibration directional signal has a maximum attenuation in the direction of the first useful signal source, and/or the second calibration directional signal has a maximum attenuation in the direction of the second useful signal source. This makes it possible to minimize the influences of the respective useful signals on the respective other calibration directional signal and therefore on the relative gain parameter in a particularly effective manner.

Advantageously, the first calibration directional signal is generated by means of adaptive directional microphony, in particular on the basis of the first and second intermediate signals, and/or the second calibration directional signal is generated by means of adaptive directional microphony, in particular on the basis of the first and second intermediate signals. As a result, it is possible to achieve the situation in which the relevant calibration directional signal has a sensitivity which is as low as possible, preferably a minimum sensitivity, in the direction of one of the two useful signal sources, on the one hand, with the result that a high attenuation, preferably a maximum attenuation, is effected in this direction, and has a sensitivity which is as high as possible, preferably a maximum sensitivity, in the direction of the respective other useful signal source.

In this case, it proves to be further advantageous if the first intermediate signal is generated on the basis of a time-delayed superposition of the first input signal with the second input signal, which is implemented by means of a first delay parameter, and/or the second intermediate signal is generated on the basis of a time-delayed superposition of the second input signal with the first input signal, which is implemented by a second delay parameter. In particular, the first and second delay parameters can be selected to be identical to one another in this case and, in particular, the first intermediate signal can be generated so as to be symmetrical to the second intermediate signal with respect to a preferred plane of the hearing aid, wherein the preferred plane is preferably assigned to the frontal plane of the wearer when wearing the hearing aid. An alignment of the directional signals with the frontal direction of the wearer facilitates the signal processing since the natural viewing direction of the wearer is taken into account as a result.

Preferably, the first intermediate signal is generated in this case as a front-facing cardioid directional signal, and/or the second intermediate signal is generated as a rear-facing cardioid directional signal. A cardioid directional signal can be formed by superposing the two input signals with respect to one another with the acoustic propagation time delay corresponding to the distance between the input transducers. As a result, depending on the sign of this propagation time delay in the superposition, the direction of the maximum attenuation is in the frontal direction (rear-facing cardioid directional signal) or in the opposite direction (front-facing cardioid directional signal). The direction of maximum sensitivity is opposite the direction of the maximum attenuation. This facilitates the further signal processing since such an intermediate signal is particularly suitable for adaptive directional microphony.

In this case, the first calibration directional signal and the second calibration directional signal are both each preferably generated on the basis of both the first intermediate signal and the second intermediate signal.

In a further advantageous configuration, the first processing directional signal is generated from the first intermediate signal, and in particular is generated so as to be "identical" to the latter, and/or the second processing directional signal is generated from the second intermediate signal, in particular is generated so as to be "identical" to the latter. In this case (and in a similar manner below), generation of the first and/or second processing directional signal from the first and/or second intermediate signal should be understood as meaning, in particular, the fact that, apart from the signal components of the "generating" signal, no signal components of other signals are included in the generated signal. Signal components of other signals are used, at best, as control signals for parameters when generating the respective processing directional signal. In this case, the first processing directional signal is generated so as to be identical to the first intermediate signal by using the first intermediate signal further as the first processing directional signal for the subsequent method steps. In this case, for reducing the complexity, it is advantageous if both the calibration directional signals and the processing directional signals are based on the same intermediate signals.

It proves to be further advantageous if the first processing directional signal is formed as a first asymmetrical superposition signal on the basis of a time-delayed superposition of the first input signal with the second input signal, which is implemented by means of asymmetrical first weighting factors, and/or the second processing directional signal is formed as a second asymmetrical superposition signal on the basis of a time-delayed superposition of the second input signal with the first input signal, which is implemented by means of asymmetrical second weighting factors. This means, in particular, that, in order to generate the first processing directional signal, the first input signal E1 is superposed with the second input signal E2 according to E1−w1·E2, in which case the weighting of the two input signals is not identical, but rather is calculated on the basis of the first asymmetrical weighting factors w1 (w1≠1). Moreover, a time delay T1 of the second input signal, for example, can also be effected, with the result that the first processing directional signal Y1(*t*) in the period can be represented as $$Y1(t)=E1(t)-w1\cdot E2(t-T1).$$

The second processing directional signal Y2(*t*) can be accordingly represented (depending on the choice of the global phase) as $$Y2(t)=E2(t)-w2\cdot E1(t-T2) \text{ and } -E2(t)+w2\cdot E1(t-T2).$$

Such first and second asymmetrical weighting factors w1, w2 (w1, w2 each ≠1) can be used to insert an additional degree of freedom, in order to thus fix the direction of maximum attenuation in the source-sensitive directional signal, as described above.

In a further advantageous configuration, a reference signal strength is determined in the direction of the second useful signal source, in particular on the basis of the first instantaneous gain factor, wherein a derived signal strength in the direction of the first useful signal source is determined on the basis of the relative gain parameter and on the basis of the reference signal strength, and wherein a complex superposition parameter for a superposition of the first processing directional signal with the second processing directional signal is determined on the basis of the derived signal strength, and the source-sensitive directional signal is generated on the basis of the associated superposition. This makes it possible to insert the additional degree of freedom by means of the complex superposition parameter, in order to thus fix the direction of maximum attenuation in the source-sensitive directional signal, as described above.

A reference signal strength is expediently determined in the direction of the second useful signal source, in particular on the basis of the first instantaneous gain factor, wherein a derived signal strength in the direction of the first useful signal source is determined on the basis of the relative gain parameter and on the basis of the reference signal strength, and wherein the asymmetrical first weighting factors and/or second weighting factors for the first and/or the second asymmetrical superposition signal are determined on the basis of the derived signal strength, and wherein the source-sensitive directional signal is generated as a first and/or second processing directional signal on the basis of the first and/or the second asymmetrical superposition signal. This is a further possible way of inserting an additional degree of freedom in order to thus fix the direction of maximum attenuation in the source-sensitive directional signal, as described above. If the source-sensitive directional signal is generated on the basis of the first and/or the second asymmetrical superposition signal, this can also be carried out by means of a corresponding superposition using a real-value superposition parameter. In particular, the reference signal strength and the derived signal strength can be used in this case as identical for determining the real superposition parameter and the respective asymmetrical weighting factors.

The invention also states a hearing system having a hearing aid which has a first input transducer for generating a first input signal from a sound signal in the environment and a second input transducer for generating a second input signal from the sound signal in the environment, and a control unit which is configured to carry out the method as claimed in one of the preceding claims. In particular, the control unit can be integrated in the hearing aid. In this case, the hearing system is provided directly by the hearing aid. The advantages mentioned for the method and its developments can be analogously applied to the hearing system.

Other features which are considered as characteristic for the invention are set forth in the appended claims.

Although the invention is illustrated and described herein as embodied in a method for directional signal processing for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Mutually corresponding parts and variables are each provided with the same reference signs in all figures.

Figure 1:
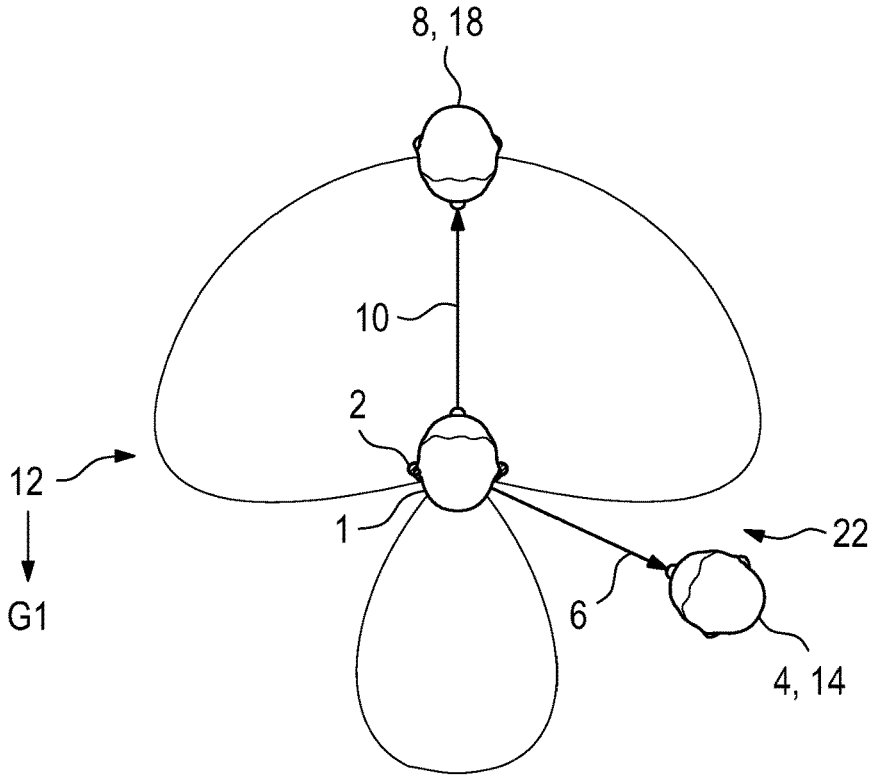
FIG. 1 is an illustration of a conversation situation of a wearer of a hearing aid with two interlocutors according to the invention.
Figure 1:
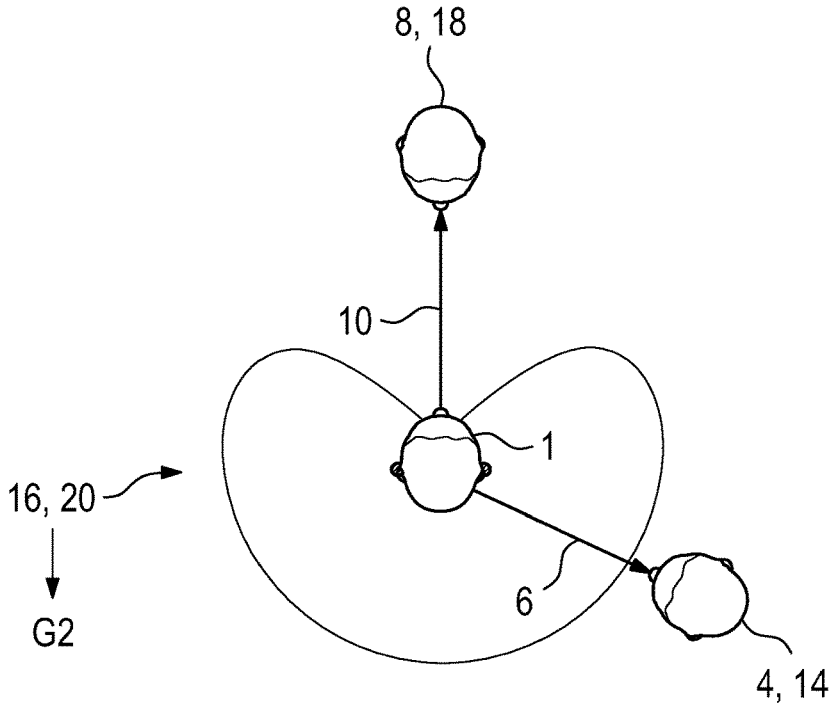

Referring now to the figures of the drawings in detail and first, particularly to FIG. 1 thereof, there is shown schematically illustrates a plan view of a wearer 1 of a hearing aid 2 who is in a conversation situation with a first interlocutor 4 and a second interlocutor 8. The first interlocutor 4 is positioned in a first direction 6 with respect to the wearer 1, and the second interlocutor 8 is positioned in a second direction 10 relative to the wearer 1. In this case, the second interlocutor 8 is the main interlocutor of the wearer 1, and the first interlocutor 4 participates in this conversation only by means of isolated speech contributions. The described conversation situation is identical in this case for the upper and lower images of FIG. 1.

In order to now reduce the peak levels of the speech contributions by the first interlocutor 4 and by the second interlocutor 8 for the wearer 1 of the hearing aid 2 in an output sound signal from the hearing aid 2, a first calibration directional signal 12 is now first of all generated, as illustrated in the upper image of FIG. 1, by means of adaptive directional microphony in such a manner that the signal has a maximum and preferably complete attenuation in the first direction 6 in which the first interlocutor 4 is positioned. This means that the speech contributions by the first interlocutor 4 are not covered by the first calibration directional signal 12. A compression factor which is therefore calculated on the basis of the first calibration directional signal 12 consequently reacts, with respect to the two useful signal sources 14, 18 given by the first and second interlocutors 4 and 8, only to the latter. In this case, a first instantaneous gain parameter G1 is determined and, with regard to the signal contributions by the second useful signal source 18 (that is to say the second interlocutor 8), determines the optimum signal amplification and therefore implicitly also a corresponding compression ratio for each moment.

The lower image of FIG. 1, in a similar manner to the upper image, shows a second calibration directional signal 16 which has a maximum and preferably complete attenuation in the second direction 10, that is to say the direction of the second interlocutor 8. Since the second direction 10 coincides with the frontal direction of the wearer 1, the second calibration directional signal 16 is in the form of a rear-facing cardioid directional signal 20. The second instantaneous gain parameter G2 which is determined on the basis of the second calibration directional signal 16 and is assigned to the latter therefore represents the optimum amplification with respect to the first interlocutor 4 and, in particular, an associated compression ratio at any moment.

In order to now be able to reduce the peak levels caused by the speech contributions both by the first interlocutor 4 and by the second interlocutor 8 to a level comfortable for the wearer 1 in an output sound signal from the hearing aid 2 for its wearer 1 by compression, such an output sound signal could now be formed, on the one hand, from a linear combination of the first and second calibration directional signals 12, 16 which are each weighted with their corresponding instantaneous gain parameters G1, G2. Since the first calibration directional signal 12 is also formed by means of adaptive directional microphony on the basis of a front-facing cardioid directional signal and on the basis of the rear-facing cardioid directional signal 20, such a linear combination would result in an output sound signal, the directional characteristic of which resembles that of the first calibration directional signal 12 in terms of shape, but the notch 22 in the maximum attenuation is shifted away from the first direction 6. This results, on the one hand, in a possibly unwanted, completely "deaf" area away from the first useful signal source 14, the orientation of which can also fluctuate, on the other hand, as a result of the dependence of such a linear combination on the speech contributions by the second interlocutor 8.

Figure 2:
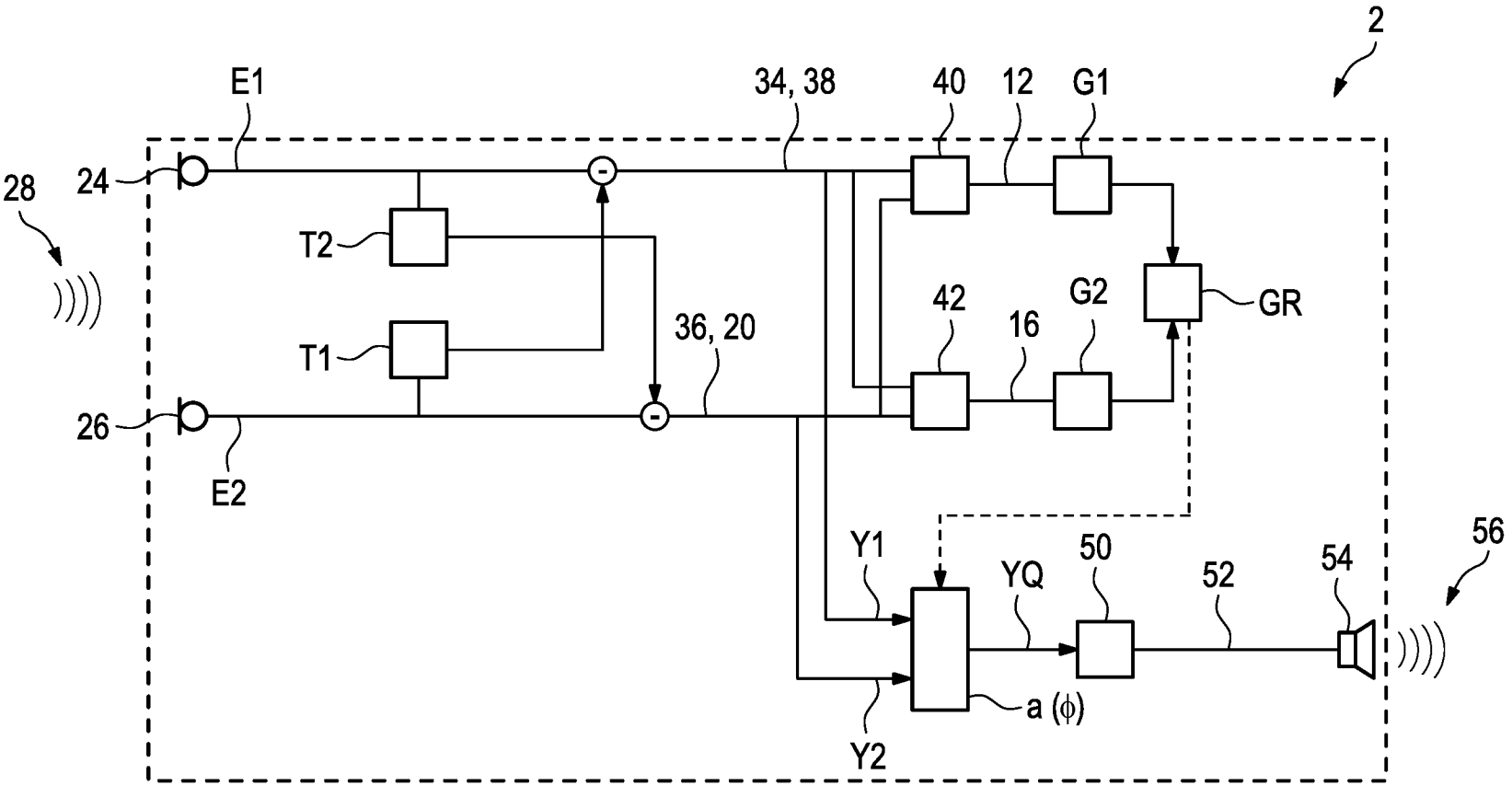
FIG. 2 is block diagram showing preferred directional signal processing for the hearing aid in the conversation situation according to FIG. 1.

FIG. 2 schematically illustrates a block diagram of a method for directional signal processing for the hearing aid 2 according to FIG. 1 in the situation described there, which method is intended to reduce, in particular, the peak levels of the two useful signal sources 14, 18 given by the respective interlocutors 4, 8. A first input transducer 24 and a second input transducer 26 are arranged in the hearing aid 2, which transducers respectively generate a first input signal E1 and a second input signal E2 from a sound signal 28. In this case, the sound signal 28 is the ambient sound which therefore also contains the speech contributions by the first interlocutor 4 and the speech contributions by the second interlocutor 8. Possible preprocessing, for example A/D conversion or the like, is intended to have already been incorporated in the input transducers 24, 26 in this case which also each have a microphone.

The first input signal E1 is now superposed with the second input signal E2, which has been delayed by a first delay parameter T1, and a first intermediate signal 34 is formed therefrom. In a similar manner, the second input signal E2 is superposed with the first input signal E1, which has been delayed by a second delay parameter T2, and a second intermediate signal 36 is formed thereby. In the present case and without restricting generality, the first and second delay parameters T1, T2 are each selected to be identical (T1=T2) and are moreover selected in such a manner that the first intermediate signal 34 is given by a front-facing cardioid directional signal 38 and the second intermediate signal 36 is given by the rear-facing cardioid directional signal 20. The first calibration directional signal 12 according to FIG. 1 is now generated on the basis of the first intermediate signal 34 and the second intermediate signal 36 by means of adaptive directional microphony 40 in such a manner that the contributions by the first interlocutor 4 are suppressed to the maximum extent in the first calibration directional signal 12. The first instantaneous gain parameter G1 determined for the first calibration directional signal 12 therefore represents the optimum amplification and compression of the signal contributions by the second interlocutor 8. The second calibration directional signal 16 is generated from the first intermediate signal 34 and the second intermediate signal 36 by means of adaptive directional microphony 42 and suppresses the contributions by the second interlocutor 8 to the maximum extent. Since the latter is in the frontal direction with respect to the wearer 1, the second calibration directional signal 16 is given by the rear-facing cardioid directional signal 20, as already mentioned. However, this situation can also change, with the result that a position change of the second interlocutor 8 can also be taken into account by means of the adaptive directional microphony 42.

The second instantaneous gain parameter G2 is now determined on the basis of the second calibration directional signal 16, and a relative gain parameter GR given in the present case by the quotient G2/G1 is formed from the second instantaneous gain parameter and the first instantaneous gain parameter G1. The relative gain parameter GR would result from the previously mentioned linear combination of the first calibration directional signal 12 with the second calibration directional signal 16, each weighted with their corresponding instantaneous gain parameters G1 and G2, if the first instantaneous gain parameter G1 were used as a global gain parameter for the resulting signal of the linear combination, wherein precisely the correct signal strength for the speech contributions by the first interlocutor 4 in the first direction 6 is produced by the relative gain parameter GR.

In order to generate the output signal 52, the first intermediate signal 34 is used as a first processing directional signal Y1 and the second intermediate signal 36 is used as a second processing directional signal Y2 in the subsequent signal processing steps. The first processing directional signal Y1 and the second processing directional signal Y2 are now superposed with a complex superposition parameter a, which is determined on the basis of the relative gain parameter GR, in a form YQ=Y1+a·Y2. The result of this superposition is a source-sensitive directional signal YQ which can possibly also be subjected to further signal processing steps 50 which are not specified in any more detail, for example additional, frequency-band-specific amplification etc. An output signal 52 is generated thereby from the source-sensitive directional signal YQ and is converted into an output sound signal 56 by an output transducer 54 of the hearing aid 2. In this case, the output transducer 54 may comprise a loudspeaker. The output sound signal 56 is then supplied to the hearing of the wearer 1.

For a sound signal which impinges on the two input transducers 24, 26 from an angle of a with respect to the frontal direction, the first and second processing directional signals Y1, Y2 can be represented as $$Y1(\omega)=A\cdot\{1-\exp[-i\omega T(1+\cos\alpha)]\}\cdot X(\omega),$$

$$Y2(\omega)=A\cdot\{-\exp(i\omega T)-\exp(-i\omega T\cdot\cos\alpha)\}\cdot X(\omega) \qquad \text{(i)}$$

where T=T1=T2 is the first and/or second delay parameter, X(ω) is the frequency response of the sound signal 28, ω is the respective frequency, A is a normalization factor and i is the imaginary unit. In this case, T is such that Y1 and Y2 result as the desired front-facing and rear-facing cardioid directional signals 38 and 20. The formulae $$YQ=Y1+a\cdot Y2,$$

$$|YQ(\omega)|^2=|H(\omega)|^2\cdot|X(\omega)|^2 \qquad \text{(ii)}$$

can now be used to determine the square of the absolute value of the transfer function H(ω) for the source-sensitive directional signal YQ on the basis of the complex-value superposition parameter a:

$$|H(\omega)|^2=2A^2\cdot[1+|a|^2+$$

$$+2\mathrm{Re}\{a\}[\cos(\omega T)-\cos(\omega T\cos\alpha)]- \qquad \text{a)}$$

$$-|a|^2\cos[\omega T(1-\cos\alpha)]-\cos[\omega T(1+\cos\alpha)]. \qquad \text{b)}$$

In this case, it is preferably required that, for an angle of incidence α=0°, the absolute value of the transfer function |H(ω)| should be independent of the frequency ω in order to thus achieve a flat frequency spectrum in the frontal direction. However, this preferred choice is not a restriction. As a result, the normalization factor A is stipulated in the two equations (i). It can now be shown that all parameters a, for which |H(ω)|^2 at the same angle α results in a minimum, are each on a circle in the complex plane, and a position of the circle is therefore relevant to the depth of the minimum at α, that is to say for the suppression of YQ at this angle:

$$\alpha(\varphi) = \frac{\sin(\omega T)}{\sin(\omega T(1-\cos\alpha))}(\cos\varphi + j\sin\varphi) + \frac{\sin(\omega T\cos\alpha)}{\sin(\omega T(1-\cos\alpha))}$$

Figure 3:
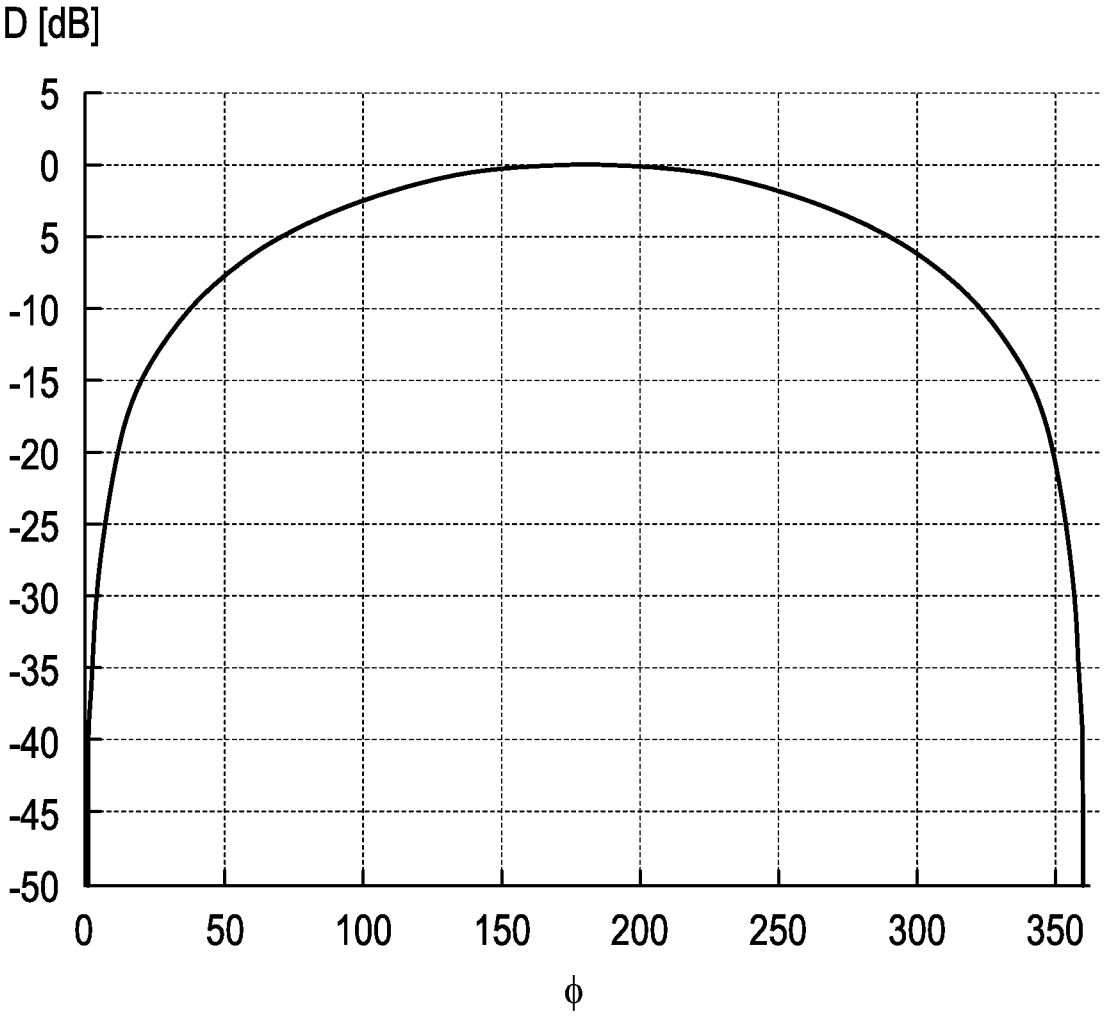
FIG. 3 is a graph showing a profile of a notch depth of a directional signal at the maximum attenuation angle in the method according to FIG. 2 on a basis of an arc parameter for the corresponding superposition parameter.

The position of the circle can be parameterized by means of an arc parameter $\varphi \in [0, 2\pi)$, with the result that the relative depth D of the minimum of $|H(\omega)|$ at a given angle α for different φ on this circle in the complex plane varies. The relative depth D of the notch produced by the attenuation in the directional characteristic of the source-sensitive directional signal YQ on the basis of this arc parameter φ is illustrated in FIG. 3. The dependencies D(φ) shown there can be tabulated, with the result that a relationship between a desired notch and the arc parameter sz for a is possible. The relative gain parameter GR, which determines the relative attenuation in the directional characteristic of the source-sensitive directional signal YQ (on the basis of the tabulated dependencies on the arc parameter φ of a), and the first instantaneous gain parameter G1 can therefore be determined using the two degrees of freedom of the absolute value |a| and of the arc parameter φ of a. It can also be seen from FIG. 3 that, for φ=0, which corresponds, as can be shown, to a real-value a, the lowest possible notch is produced.

Figure 4:
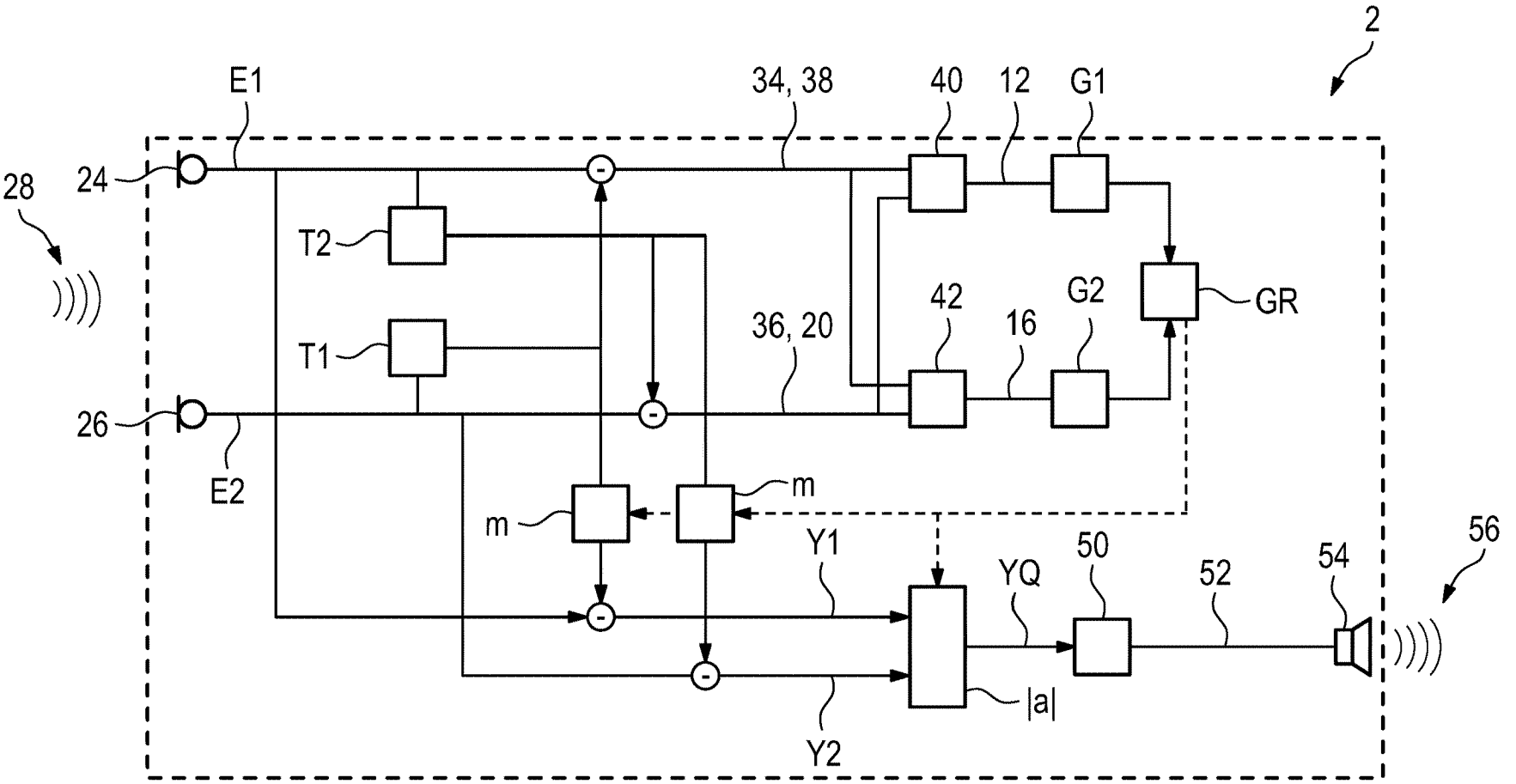
FIG. 4 is a block diagram of an alternative configuration of the directional signal processing according to FIG. 2.

FIG. 4 schematically illustrates a block diagram of an alternative configuration of the method for directional signal processing according to FIG. 2. In this case, the relative gain parameter GR is determined in a completely identical manner to the method shown in FIG. 2; only the generation of the output signal 52 is changed in the present case. The first and second processing directional signals Y1 and Y2 are now each formed on the basis of the first and second input signals E1, E2 which are superposed in a delayed manner with respect to one another with the delay parameter T (=T1=T2), but an additional degree of freedom is also introduced during the superposition by means of a real-value adjustment parameter m. The equations, corresponding to the equations (i) according to FIG. 2, for the first and second processing directional signals Y1, Y2 on the basis of the frequency ω, the frequency response X(ω) of the sound signal 28 and the adjustment parameter m are now:

$$Y1(\omega)=A\cdot\{1-m\cdot\exp[-i\omega T(1+\cos\alpha)]\}\cdot X(\omega),$$

$$Y2(\omega)=A\cdot\{\exp(-i\omega T)-m\cdot\exp(-i\omega T\cdot\cos\alpha)\}\cdot X(\omega) \quad \text{(iii)}$$

The source-sensitive directional signal YQ is now formed on the basis of the first and second processing directional signals Y1, Y2 according to YQ=Y1+a·Y2, in which case the superposition parameter a is now selected to have a real value. Like in equation (ii) above, the transfer function H(ω) can now be determined on the basis of the superposition parameter a and the adjustment parameter m:

$$|H(\omega)|^2=A^2\cdot[1+m^2+|a|^2+a^2m^2$$

$$-4ma\cdot\cos(\omega T\cos\alpha)+2a(1+m^2)\cos(\omega T)- \quad \text{a)}$$

$$-2ma^2\cdot\cos[\omega T(1-\cos\alpha)]-2m\cdot\cos[\omega T(1+\cos\alpha)]] \quad \text{b)}$$

The normalization factor A is then preferably selected in such a manner that the absolute value of the transfer function |H(ω)| is independent of the frequency ω in the frontal direction, that is to say for α=0°. As a result, the normalization factor A is stipulated in the two equations (iii) as $$A = \frac{1}{\sqrt{1+m^2+a(1-m)^2(a+2\cos(\omega T))-2m\cos(2\omega T)}}$$

It can now be shown that, for all real-value superposition parameters a, the minimum of |H(ω)|^2 at α, that is to say the angle of the maximum attenuation, is independent of the adjustment parameter m. The values of the superposition parameter a and of the adjustment parameter m can therefore be selected on the basis of the first instantaneous gain parameter G1 and the relative gain parameter GR in such a manner that, on the one hand, the instantaneous total volume and possibly a compression ratio resulting therefrom have the correct value and, on the other hand, the correct relative attenuation of the speech contributions by the first interlocutor 4 in FIG. 1 is effected in the first direction 6, by equating it with α in the corresponding equations, in order to control the speech signals from both interlocutors 4, 8 using the instantaneous first gain parameter G1. In this case, it is of great benefit that the minimum of the square of the absolute value or the absolute value of the transfer function |H(ω)| is independent of the adjustment parameter m, with the result that the relative attenuation can be controlled on the basis of the relative gain parameter GR using the adjustment parameter, for example by means of accordingly tabulated values.

The output signal 52 is now generated again on the basis of the source-sensitive directional signal YQ generated from the first and second processing directional signals Y1, Y2, as described. As a further alternative embodiment which is not illustrated in any more detail, it is likewise conceivable to use the adjustment parameter m only in one of the two processing directional signals Y1, Y2 (for example in Y2), unlike in equation (iii), and to use the other processing directional signal (for example Y1) as the corresponding cardioid directional signal (for example the front-facing cardioid directional signal 38).

Although the invention has been described and illustrated more specifically in detail by means of the preferred exemplary embodiment, the invention is not restricted by the examples disclosed and other variations can be derived therefrom by a person skilled in the art without departing from the scope of protection of the invention.

LIST OF REFERENCE SIGNS

1 Wearer
2 Hearing aid
4 First interlocutor
6 First direction
8 Second interlocutor
10 Second direction
12 First calibration directional signal
14 First useful signal source
16 Second calibration directional signal
18 Second useful signal source
20 Rear-facing cardioid directional signal
22 Notch
24 First input transducer
26 Second input transducer
28 Sound signal
34 First intermediate signal
36 Second intermediate signal
38 Front-facing cardioid directional signal
40 Adaptive directional microphony
42 Adaptive directional microphony
50 Signal processing steps

52 Output signal
54 Output transducer
56 Output sound signal
a Superposition parameter
D Relative depth
E1 First input signal
E2 Second input signal
G1 First instantaneous gain parameter
G2 Second instantaneous gain parameter
GR Relative gain parameter
T1 First delay parameter
T2 Second delay parameter
Y1 First processing directional signal
Y2 Second processing directional signal
YQ Source-sensitive directional signal
φ Arc parameter

The invention claimed is:

1. A method for directional signal processing for a hearing aid, which comprises the steps of:

generating, via a first input transducer of the hearing aid, a first input signal from a sound signal in an environment;

generating, via a second input transducer of the hearing aid, a second input signal from the sound signal in the environment;

generating a first calibration directional signal having a relative attenuation in a direction of a first useful signal source in the environment on a basis of the first input signal and on a basis of the second input signal;

generating a second calibration directional signal having a relative attenuation in a direction of a second useful signal source in the environment on a basis of the first input signal and on a basis of the second input signal;

determining a relative gain parameter on a basis of the first calibration directional signal and the second calibration directional signal;

generating a first processing directional signal and a second processing directional signal on a basis of both the first input signal and the second input signal;

generating a source-sensitive directional signal on a basis of the first processing directional signal, the second processing directional signal and the relative gain parameter; and generating an output signal of the hearing aid on a basis of the source-sensitive directional signal.

2. The method according to claim 1, which further comprises:

determining a first instantaneous gain parameter on a basis of the first calibration directional signal;

determining a second instantaneous gain parameter on a basis of the second calibration directional signal; and determining the relative gain parameter on a basis of the first instantaneous gain parameter and the second instantaneous gain parameter.

3. The method according to claim 2, which further comprises:

determining a reference signal strength in the direction of the second useful signal source;

determining a derived signal strength in the direction of the first useful signal source on a basis of the relative gain parameter and on a basis of the reference signal strength; and determining a complex superposition parameter for a superposition of the first processing directional signal with the second processing directional signal on a basis of the derived signal strength, and the source-sensitive directional signal is generated on a basis of an associated superposition.

4. The method according to claim 1, which further comprises generating a first intermediate signal and a second intermediate signal on a basis of both the first input signal and the second input signal.

5. The method according to claim 4, which further comprises:

generating the first intermediate signal on a basis of a time-delayed superposition of the first input signal with the second input signal, which is implemented by means of a first delay parameter; and/or generating the second intermediate signal on a basis of a time-delayed superposition of the second input signal with the first input signal, which is implemented by means of a second delay parameter.

6. The method according to claim 5, which further comprises:

generating the first intermediate signal as a front-facing cardioid directional signal; and/or generating the second intermediate signal as a rear-facing cardioid directional signal.

7. The method according to claim 4, which further comprises generating both the first calibration directional signal and the second calibration directional signal on a basis of both the first intermediate signal and the second intermediate signal.

8. The method according to claim 4, which further comprises:

generating the first processing directional signal from the first intermediate signal; and/or generating the second processing directional signal from the second intermediate signal.

9. The method according to claim 4, which further comprises:

forming the first processing directional signal as a first asymmetrical superposition signal on a basis of a time-delayed superposition of the first input signal with the second input signal, which is implemented by means of asymmetrical first weighting factors; and/or forming the second processing directional signal as a second asymmetrical superposition signal on a basis of a time-delayed superposition of the second input signal with the first input signal, which is implemented by means of asymmetrical second weighting factors.

10. The method according to claim 9, which further comprises:

determining a reference signal strength in the direction of the second useful signal source;

determining a derived signal strength in the direction of the first useful signal source on a basis of the relative gain parameter and on a basis of the reference signal strength;

determining the asymmetrical first weighting factors and/or the asymmetrical second weighting factors for the first asymmetrical superposition signal and/or the second asymmetrical superposition signal on a basis of the derived signal strength; and generating the source-sensitive directional signal as the first processing directional signal and/or the second processing directional signal on a basis of the first asymmetrical superposition signal and/or the second asymmetrical superposition signal.

11. The method according to claim 1, wherein:

the first calibration directional signal has a maximum attenuation in the direction of the first useful signal source; and/or the second calibration directional signal has a maximum attenuation in the direction of the second useful signal source.

12. The method according to claim 1, which further comprises:

generating the first calibration directional signal by means of adaptive directional microphony; and/or generating the second calibration directional signal by means of the adaptive directional microphony.

13. A hearing system, comprising:

a hearing aid having a first input transducer for generating a first input signal from a sound signal in an environment and a second input transducer for generating a second input signal from the sound signal in the environment; and a controller configured to carry out a method for directional signal processing for said hearing aid, said controller configured to:

generate a first calibration directional signal having a relative attenuation in a direction of a first useful signal source in the environment on a basis of the first input signal and on a basis of the second input signal;

generate a second calibration directional signal having a relative attenuation in a direction of a second useful signal source in the environment on a basis of the first input signal and on a basis of the second input signal;

determine a relative gain parameter on a basis of the first calibration directional signal and the second calibration directional signal;

generate a first processing directional signal and a second processing directional signal on a basis of both the first input signal and the second input signal;

generate a source-sensitive directional signal on a basis of the first processing directional signal, the second processing directional signal and the relative gain parameter; and generate an output signal of the hearing aid on a basis of the source-sensitive directional signal.

* * * * *